US008544134B2

(12) United States Patent
Del Rosso

(10) Patent No.: US 8,544,134 B2
(45) **Date of Patent: *Oct. 1, 2013**

(54) TIGHT SPACE, INSIDE BOAT THRUHOLE FITTING CLEARING

(76) Inventor: Edward J. Del Rosso, Matawan, NJ (US)

( * ) Notice: Subject to any disclaimer, the term of this patent is extended or adjusted under 35 U.S.C. 154(b) by 146 days.

This patent is subject to a terminal disclaimer.

(21) Appl. No.: 12/927,382

(22) Filed: Nov. 15, 2010

(65) Prior Publication Data

US 2012/0118403 A1 May 17, 2012

(51) Int. Cl.
*B08B 9/00* (2006.01)

(52) U.S. Cl.
USPC ..... 15/104.03; 15/104.05; 137/242; 137/244; 137/245.5

(58) Field of Classification Search
USPC ..... 15/104.03, 104.05, 104.16; 137/242, 137/244, 245.5
See application file for complete search history.

(56) References Cited

U.S. PATENT DOCUMENTS 3,174,777 A * 3/1965 Evans et al. ..... 285/252
4,592,505 A * 6/1986 Bruninga et al. ..... 239/69
4,898,201 A * 2/1990 Conley et al. ..... 137/245.5
5,417,460 A * 5/1995 Lunder ..... 285/253
5,454,602 A * 10/1995 Anderson et al. ..... 285/1
5,516,077 A * 5/1996 Roberts ..... 251/148
5,566,416 A * 10/1996 Karls ..... 15/104.04
5,743,358 A * 4/1998 Bedi et al. ..... 184/1.5
6,039,320 A * 3/2000 MacDonald ..... 277/370
6,206,021 B1 * 3/2001 Hartman et al. ..... 137/15.06
6,206,344 B1 * 3/2001 Takahara ..... 251/149.6
6,283,139 B1 * 9/2001 Symonds et al. ..... 137/78.3
6,286,171 B1 * 9/2001 Sztymelski ..... 15/104.001
6,393,645 B1 * 5/2002 Kadinger ..... 15/104.04
6,786,516 B2 * 9/2004 Cronley ..... 285/322
6,908,119 B2 * 6/2005 Murken ..... 285/305
6,920,663 B2 * 7/2005 Petit ..... 15/104.33
7,506,395 B2 * 3/2009 Eldridge ..... 15/104.05
2004/0201213 A1 * 10/2004 Lipscomb et al. ..... 285/242
2012/0086201 A1 * 4/2012 Murken ..... 285/305

* cited by examiner

*Primary Examiner* — Monica Carter
*Assistant Examiner* — Michael Jennings
(74) *Attorney, Agent, or Firm* — Charles Brodsky

(57) ABSTRACT

A kit for cleaning clogged conduits and thruhole fitting valves in water intake systems of pleasure boats, fishing boats, yacht and small marine craft includes a hollow, substantially cylindrical male hose coupler connected to a nipple or elbow joined with the valve, and at least one of a cap and plug having a central orifice to receive a shaft of larger diameter able to be force-fitted through the orifice, the coupler and the valve when opened, and of a strength sufficient to force-free any matter clogging the input hose to the valve from acceptable performance usage.

15 Claims, 9 Drawing Sheets

TIGHT SPACE, INSIDE BOAT THRUHOLE FITTING CLEARING

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to pleasure boat, fishing boat and yacht marine craft, in general, and to onboard systems employed for cooling their engines and for operating their onboard toilets and refrigerators, in particular.

2. Description of the Related Art

As will be understood, rivers, large lakes and open waters where these craft may travel typically contain natural weed growth, algae, leaves and like accumulations—as well as unnatural debris such as plastic bags, cloth rags, paper products, etc. Although attempts are taken to prevent the entry of all these materials into the intake conduits of the craft to prevent them from fouling pumps and filters, oftentimes, the thruhole fittings become clogged. On such occasions, it is not unusual for an occupant of the vessel to enter the water himself/herself to try to unclog the water intake conduit by hand. When no one on the craft is willing to enter the water where, for example, extensive weed growth is present, the solution is to call for a tow to bring the craft to a service area where an experienced technician would attempt to clear the fitting. On the other hand, where the clogging takes place while the craft is in the bay or on the sea, almost no one is ever willing to go into the very deep water to try to clear the fitting from below; there, the call for assistance is almost always made. This is especially the situation where the water intake conduit becomes clogged by barnacles which grow inside the conduit.

In all these situations of clogging, depending on the conditions, the marine engine can shut off, the onboard toilet may not flush or the refrigerator might stop working. In each instance, it becomes necessary to manually clear the intake conduit, and from outside the craft.

OBJECTS OF THE INVENTION

It is an object of the present invention, therefore, to provide a new and improved manner of clearing a clogged thruhole fitting regardless of the cause of its blockage.

It is an object of the present invention, also, to provide apparatus to enable the clearing to be accomplished from inside the craft, without having to enter the water.

It is an object of the present invention, furthermore, to provide an apparatus to enable the clearing to take place in substantially the same manner, utilizing the same type of operation, for a variety of water intake conduits to satisfy a variety of onboard uses on the craft, while realizing that some of the conduits may be of different diameter.

It is an object of the present invention, additionally, to allow these clearings of clogged intake conduits to be had without any need for retrofitting an existing craft design—as would be needed in those manufactures, for example, which recommend the use of a compressed air utilization to clear coarse material entry to begin with.

Furthermore, it is an object of the invention to provide this new and improved manner of clearing those clogged thruhole fittings which are positioned in tight-space locations where head-room access is limited or where ease in getting to the inside thruhole fitting is restricted.

As will be appreciated, while outside-the-boat thruhole fittings can easily be cleared with a male hose coupler of the type described in my pending patent application filed Nov. 12, 2009 as Ser. No. 12/589,987, such male hose coupler might not be as usable in clearing thruhole fittings where the head-room available, as in crafts of smaller size, might restrict the efficiency of clearing whatever clogging exists.

As will be appreciated, satisfying these objectives enables the small-sized marine craft to continue on its way, without the need for any occupant to enter the water to clear the fitting, without any need for seeking assistance to tow the craft to a staging area for service, and without any need for redesigning or altering the existing craft structure.

SUMMARY OF THE INVENTION

As will become clear from the following description, one aspect of the present invention attains all these objectives through the use of a different male hose coupler, and a closed-end cap having a central orifice of predetermined diameter through which a shaft is force-fitted to extend beyond the thruhole fitting valve into the water—yet with the cap being flexible and resilient to accept manual rotation of the shaft through the orifice in substantially 360° rotation in force-freeing the valve of any clogging material. As will be described, the hose coupler joins with the nipple or elbow coupled to the thruhole fitting valve, from which the hose to the pump is first disconnected with the valve closed—the valve then being opened once again when the hose coupler and shaft are in place. As will also become apparent, these objectives can be satisfied with the described kit of the invention serving as a separate, stored article of repair aboard the small-sized boat or marine craft until its component parts are needed to clean the clogging of the thruhole fitting valve.

In a preferred embodiment of this aspect of the invention, a hollow, substantially cylindrical male hose coupler is employed having two or more outwardly extending flanges of progressively smaller diameter in linear progression from the first, or, cap end towards an opposite end in allowing the use of the invention with successively smaller diameter caps in use with the coupler. Such male hose coupler will be seen to have external threads at its opposite end to secure to the internal threads of the typical thruhole fitting valve. As will be appreciated, caps of differing diameter can be employed (depending on need) with couplers whose diameter is of matching dimension—or, in a second aspect of the invention, a single size cap can be utilized with additional, replaceable rings of gradually lessened diameter to nest with one another in dealing with different diameter couplers. As will also be appreciated, the differently sized outwardly extending flanges of the couplers are employable with different diameter hoses in servicing the engine, the toilet, the refrigerator, etc. found on the boat or craft.

And, as will further become clear, a portion of the hose from the pump itself could be utilized along with a separately provided plug according to a third aspect of the invention, to effect the clearing of the clogged thruhole fitting.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1A:
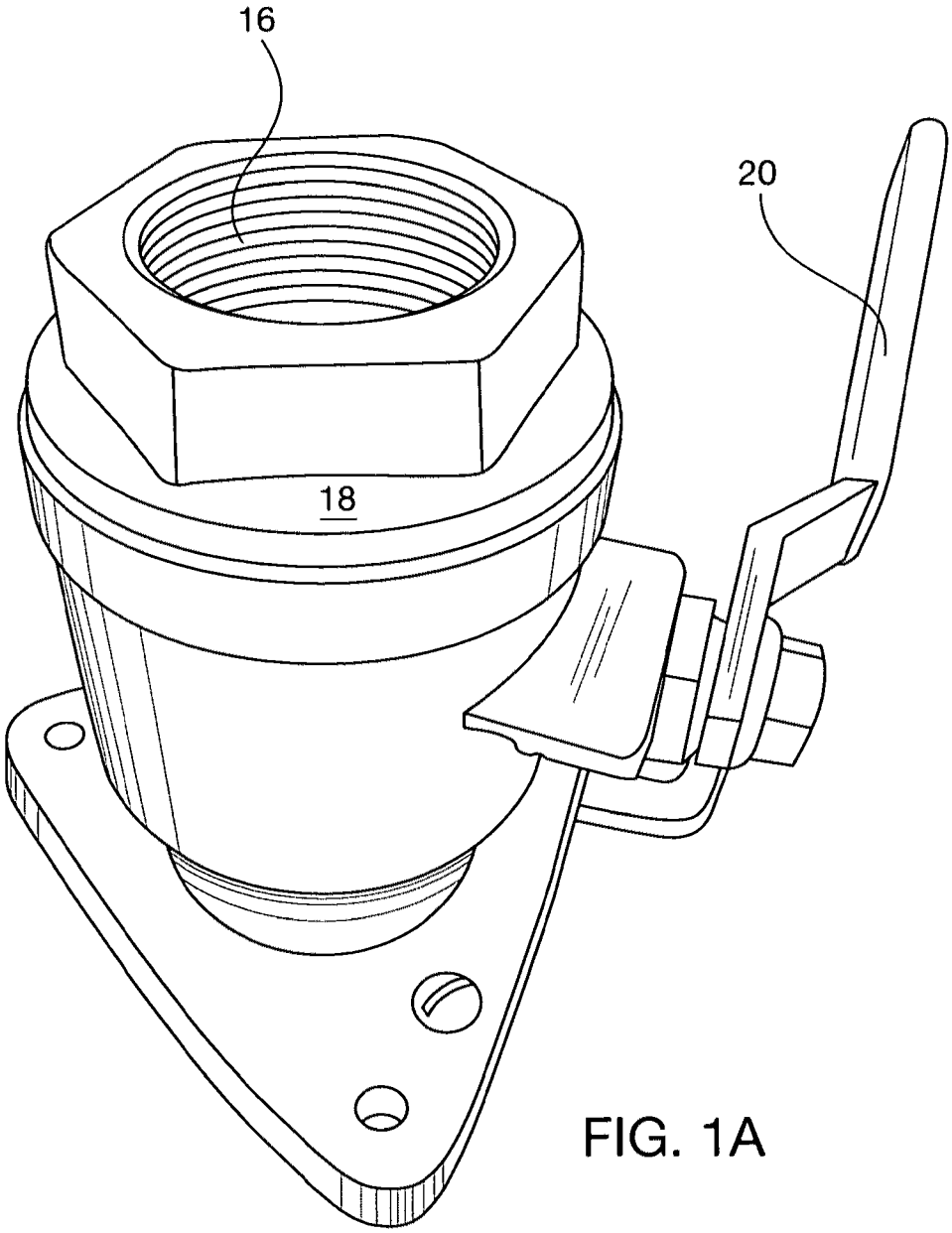
FIGS. 1*a*, 1*b* and 1*c* are illustrations of typical prior art components found in water intake systems of various size pleasure boats and marine craft—of a thruhole fitting valve, a nipple coupler, and an elbow coupler, respectively.
Figure 1B:
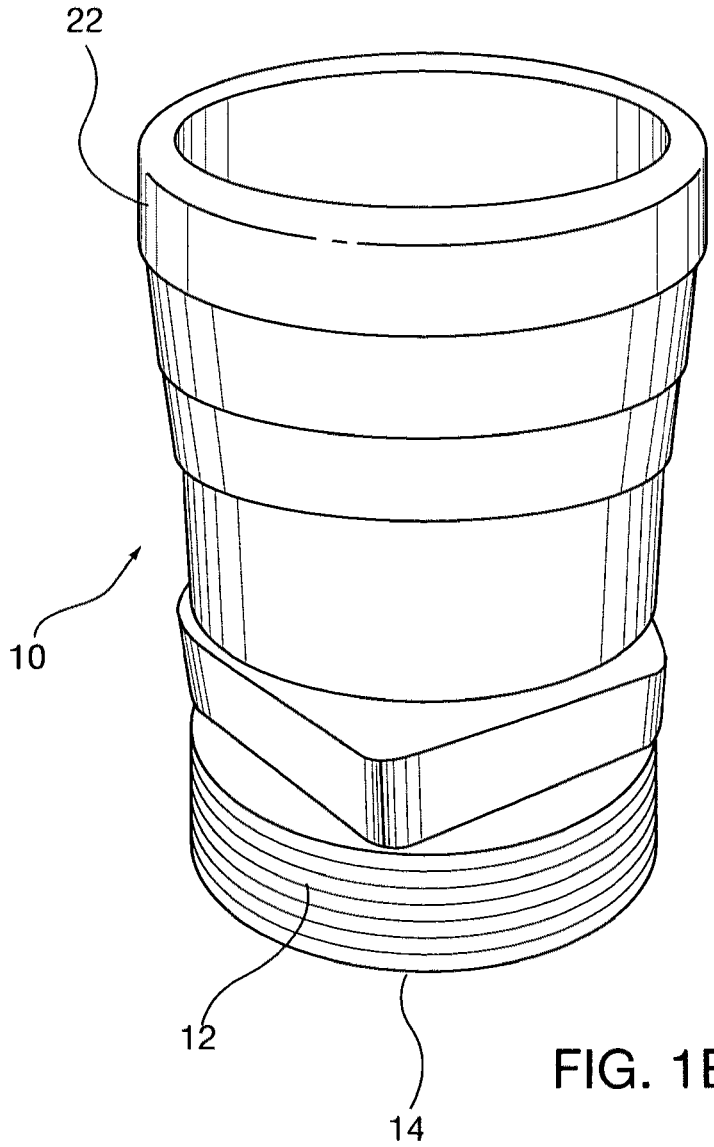

The prior art nipple coupler (or "nipple") 10 of FIG. 1*b* includes external threads 12 at its lower end 14 to connect with the internal threads 16 of the prior art thruhole fitting valve 18 of FIG. 1*a*. A handle 20 serves to open the valve 18 when rotated vertically and serves to close the valve 18 when rotated to a horizontal position. In use, a plastic or rubber hose (not shown) couples over the upper end 22 of the nipple 10 to connect the valve 18 with a pump (not shown) to provide marine water to cool the boat or yacht's engine, or to operate the onboard toilets and refrigerators. A clamp (also not shown) typically is used to secure that hose at the upper end 22 of the nipple 10. An orifice is provided in the bottom of the valve 18 to receive another hose serving as a conduit for the river, lake or open waters to be drawn in and utilized in these manners when the valve is opened and the pump turned "on".

Figure 1C:
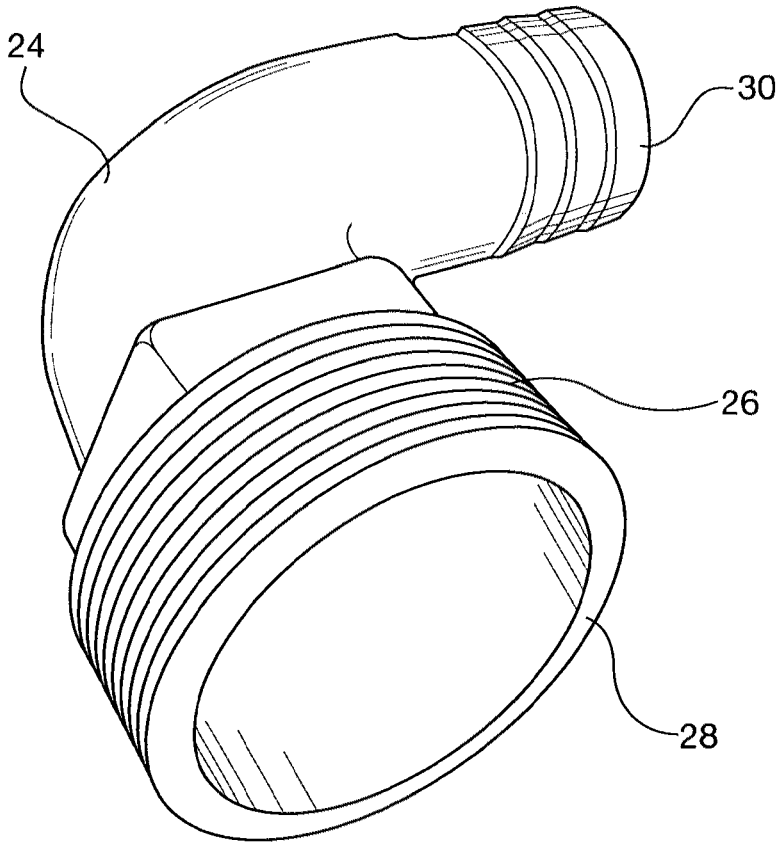
Figure 2D:
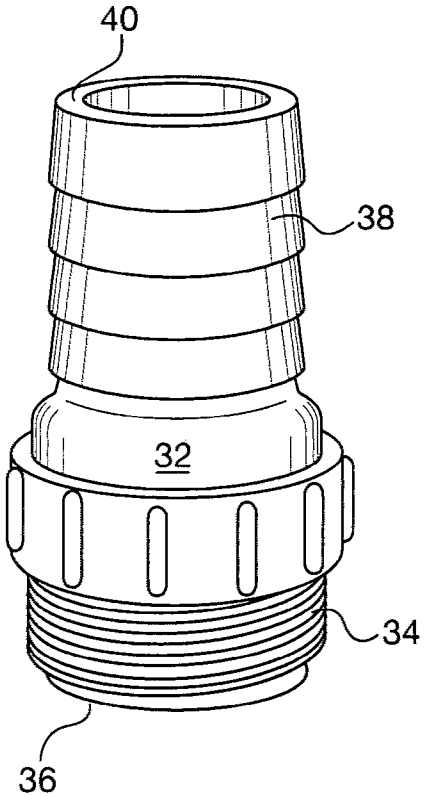
FIGS. 2*a*, 2*b*, 2*c* and 2*d* are illustrations of a series of prior art male hose couplers useful in the attainment of the objectives of the present invention.
Figure 2C:
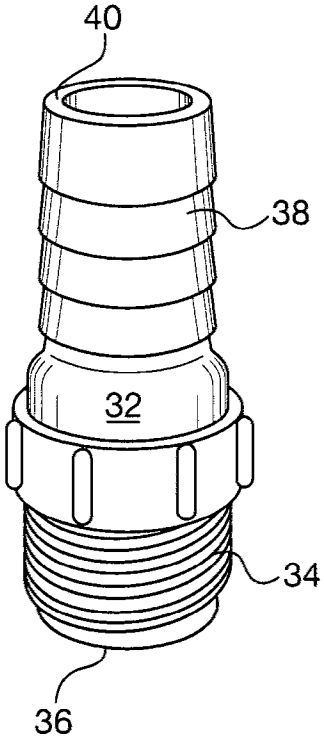
Figure 2B:
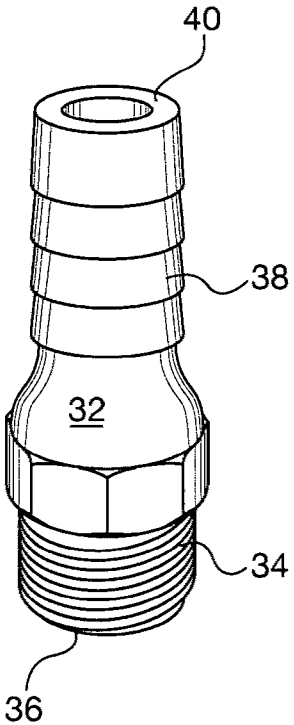
Figure 2A:
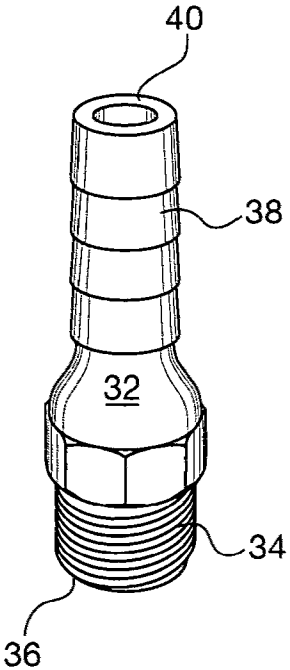

In those instances where insufficient room exists on the craft to run a hose vertically from the upper end 22 of the nipple 10 to the pump, the elbow 24 of FIG. 1*c* is employed instead. There, the external threads 26 of the elbow at its one end 28 connect with the internal threads 16 of the thruhole fitting valve 18 and the hose to the pump couples over in similar manner to its right angle-bent end 30. A clamp (similarly not shown) secures the hose at the elbow end 28 in its path to the pump.

FIGS. 2*a*, 2*b*, 2*c* and 2*d* illustrate increasingly sized hollow, substantially cylindrical prior art male hose couplers 32 having external threads 34 at a lower end 36. Outwardly extending flanges 38 extend linearly from an opposite upper end 40 to the lower end 36. In accordance with the invention, each coupler 32 is selected of a size so that its external threads 34 couple with the internal threads 16 of whatever sized thruhole fitting valve 18 of FIG. 1*a* is of concern, after its nipple coupler 10 and clamped hose are first removed. That typically depends upon the function which the valve plays in the water conduit arrangement on the marine craft. Although four flanges 38 are shown in FIGS. 2*a*-2*d* of substantially the same diameter on each coupler, any number of flanges could be utilized, of the same or progressively different diameters along their respective lengths.

FIGS. 3*a*, 3*b*, 3*c* and 3*d* illustrate increasingly sized sealing caps 42 and hose clamps 44 in accordance with the first aspect of the invention, to tighten over and secure the caps 42 to the couplers 32 of FIGS. 2*a*, 2*b*, 2*c* and 2*d*. The inside diameter 46 of each cap 42 is selected to fit with one of these couplers 32, with each hose clamp 44 being of a dimension to secure the two together. For the four couplers of FIGS. 2*a*-2*d* (for use with different sized thruhole fitting valves on the boat or craft), a similar number of caps could be utilized, along with appropriately sized clamps. As illustrated in FIGS. 3*a*-3*d*, a central orifice 50 is provided in each cap.

Figure 3D:
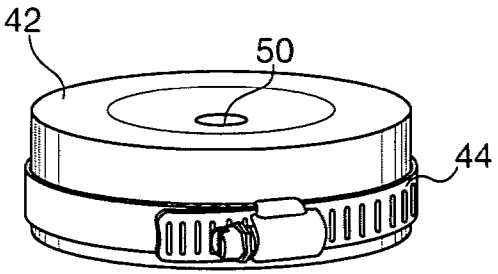
FIGS. 3*a*, 3*b*, 3*c* and 3*d* are illustrations of cap and clamp relationships helpful in understanding the first aspect of the teachings of the invention with respect to the couplers of FIGS. 2*a*, 2*b*, 2*c* and 2*d;*
Figure 3C:
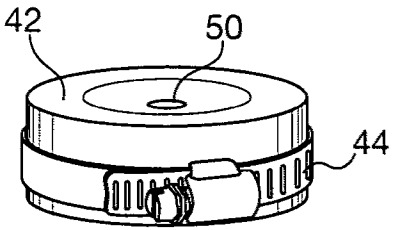
Figure 3B:
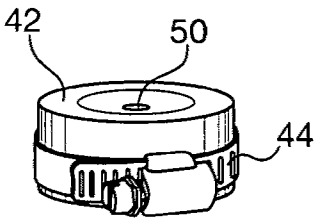
Figure 3A:
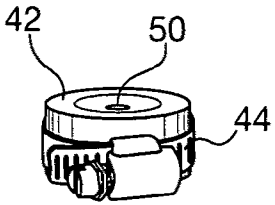
Figure 4A:
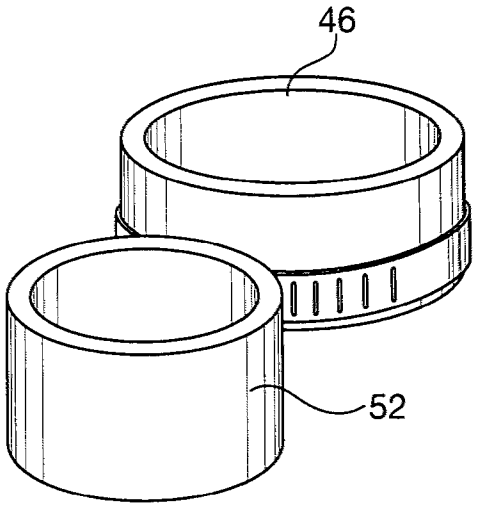
FIGS. 4*a*, 4*b* and 4*c* are illustrations of various ring relationships helpful in understanding the second aspect of the teachings of the invention.
Figure 4B:
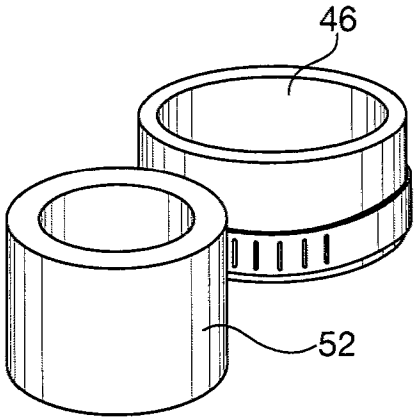
Figure 4C:
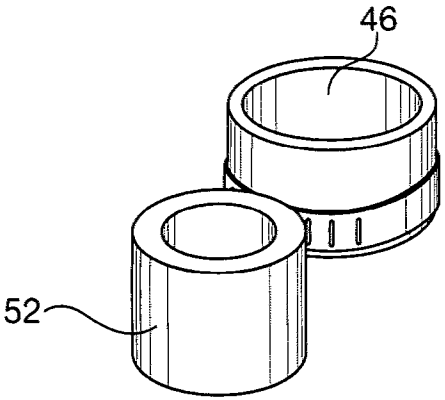

However, in the second aspect of the invention, only one sealing cap 42 need be provided, with only one hose clamp 44, and yet obtaining the same benefits. Here, a series of progressively smaller diameter rings 52 may be inserted within the underside of the cap of FIG. 3*a*, so that the effect of a smaller diameter cap can result. By force-fitting the ring of FIG. 4*a* into the underside of the cap of FIG. 3*a* (shown alongside the ring), the cap of FIG. 3*b* effectively results. By force-fitting the ring of FIG. 4*b* into the ring of FIG. 4*a*, the cap of FIG. 3*c* can effectively follow. By force-fitting the ring of FIG. 4*c* into the ring of FIG. 4*b*, the cap of FIG. 3*d* is formed. These ring-insertions thus progressively decrease the diameter afforded by the cap. In such manner, only one cap 42 and one clamp 44 would be required to operate with whatever the hose coupler is to be joined to the thruhole fitting valve in question.

Figure 5:
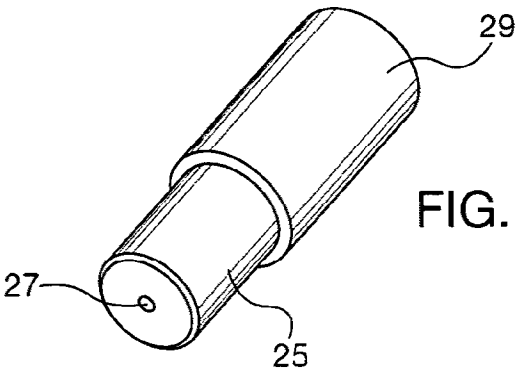
FIG. 5 is an illustration of how the hose from the pump can itself be used with a separately provided plug according to the third aspect of the present invention.

The third aspect of the invention proceeds on the recognition that the hose from the pump to the intake conduit usually has a fair amount of play built into it. A separately provided plug with its own central orifice may be inserted into a 2" or so length cut from the hose at the thruhole fitting end, and there clamped to the hose. The plug 25, its orifice 27, and the cut-off piece of the hose 29 are illustrated in FIG. 5—appreciating that if the hose were not long enough to begin with, a separate length of hose could be provided, of inside diameter set to match with the plug to be inserted.

Figure 6A:
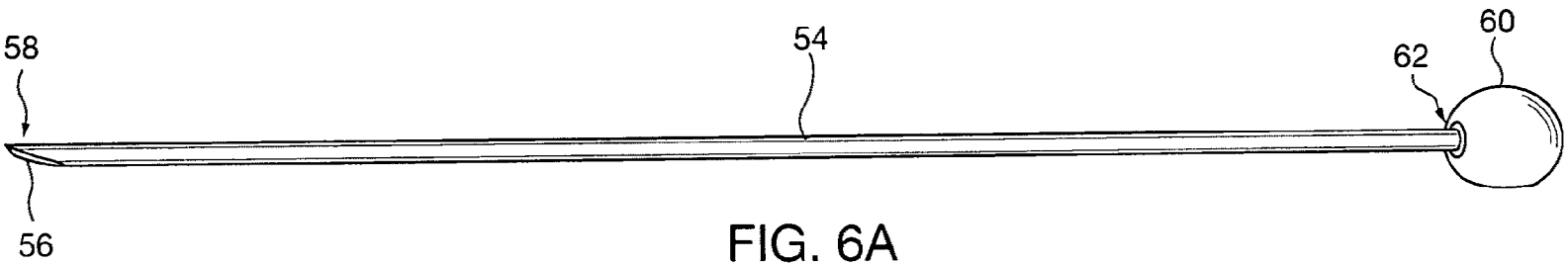
FIGS. 6*a*, 6*b* and 6*c* are illustrations of a first shaft relationship for operating the invention.
Figure 6B:
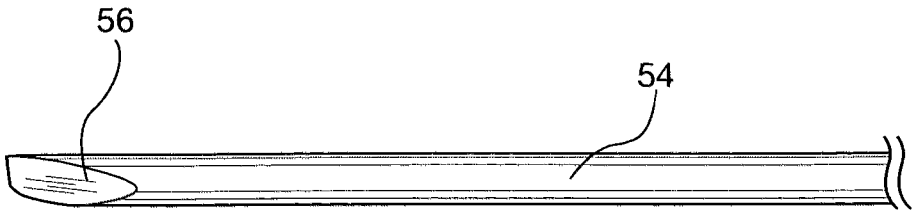
Figure 6C:
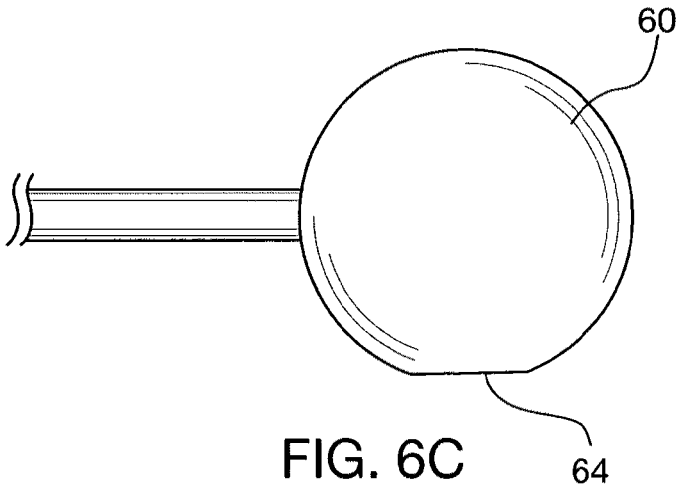

In accordance with these 3 aspects of the invention, a shaft 54 of a diameter slightly greater than that of the orifice 50 or the orifice 27 is provided. Shown in FIG. 6*a*, the shaft 54 is of a length to be inserted through the cap orifice 50 (or through the plug orifice 27), through the hose coupler 32, through the nipple 10 and through the valve 18, with the shaft being of a composition sufficiently strong to force-free the valve 18 of any matter clogging it. The shaft then becomes effective to clear whatever clogging exists in the valve 18 from inside the boat or craft, without requiring anyone to leave the vessel and enter the water. As more particularly shown in FIGS. 6*b* and 6*c*, one way of accomplishing this follows by providing the shaft with a slanted groove cutout 56 at a lower end 58 and a handle 60 at an upper end 62. Such slanted cutout 56 facilitates the use of the shaft in additionally clearing barnacles that may form in the hose coupling the marine water to the valve 18. The handle 60 is of a substantially circular knob configuration with a flat portion 64 in alignment with the cutout 56 so as to assist a user in determining the orientation of the shaft at any time in clearing barnacles from the sides of the input hose (FIG. 6*c*). The cap in this configuration is selected of a resilience to first permit the larger diameter shaft 54 to penetrate through the cap orifice 50 or plug orifice 27, and then to permit manual rotation of the shaft 54 in and about the orifices in a substantially 360° plane of orientation from side-to-side and front to back.

Figure 7A:
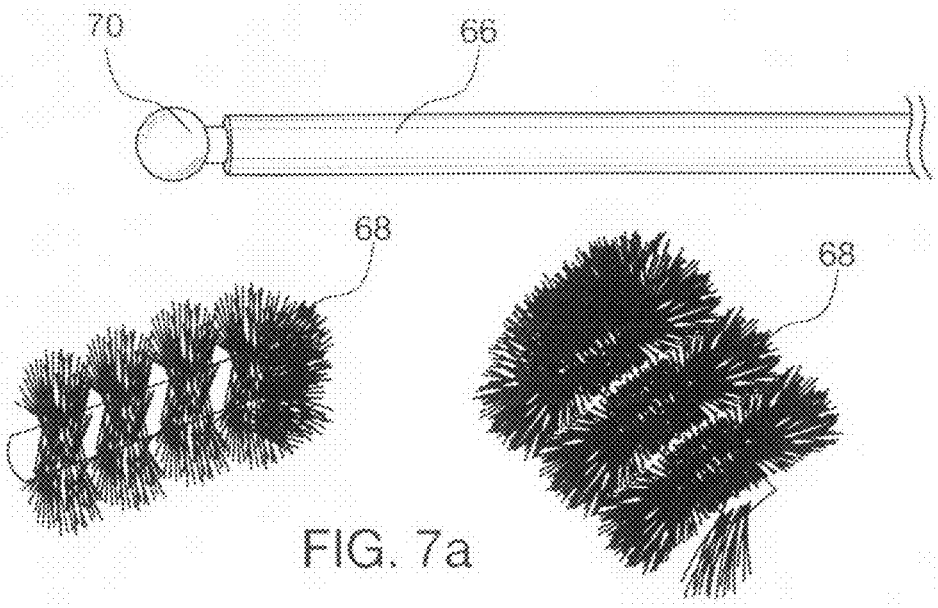
FIGS. 7*a* and 7*b* are illustrations of a second shaft relationship for the invention.
Figure 7B:
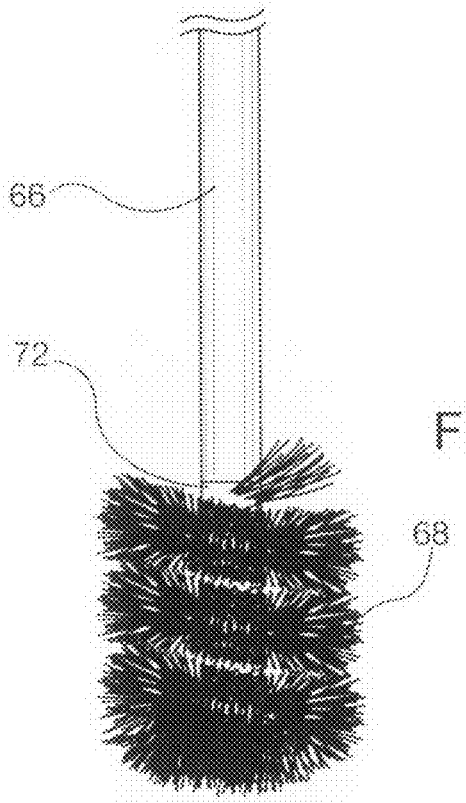

FIG. 7*a* illustrates an alternative shaft 66 without the previously grooved-cutout lower end 58 as a safety factor. Wire brushes 68 could, in such arrangement, either clip onto the lower end 70 of the shaft 66 (as at 72 in FIG. 7*b*) or be part of the shaft construction itself in providing an ease of cleaning of the thruhole fitting valve. Again, just as the size of the valve dictates the size of the hose coupler and cap (or plug) to be utilized, the location of the valve dictates the length of whatever shaft may be utilized. But with each possibility, it will be appreciated that all that is required is the hose coupler, the cap or plug with its central orifice, and a shaft. With the cap or plug constructed of a heavy duty rubber, and with a coupler constructed of a heavy duty molded plastic, any fabrication for the shaft can be selected. A handle similar to that of FIG. 6*c* could be utilized here also.

As will become clear from the following description, the kit of the invention is to be included within a package to be stored aboard the pleasure, fishing boat or yacht, awaiting the time for its need in clearing the thruhole fitting valve when the valve becomes clogged.

Figure 8:
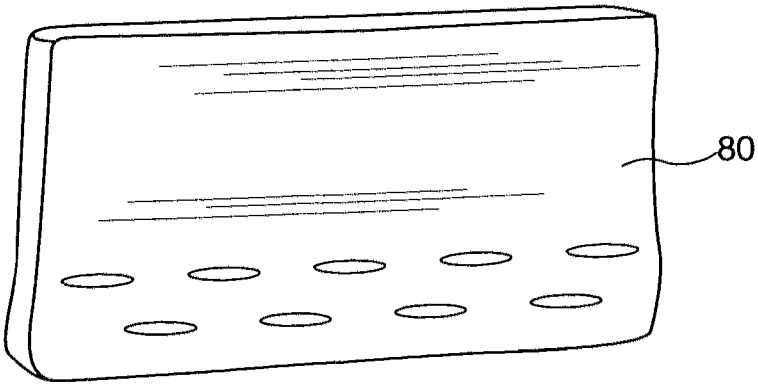
FIG. 8 illustrates a storage compartment for the component parts employed to clear a valve blockage in the tight spaced limitations of the smaller head-room marine boats and craft.

In use of the invention, while everything is operating normally aboard the boat or craft, the kit is included in a storage compartment 80 (FIG. 8). Once it is determined that a clog exists, the hose connected to the engine, toilet, refrigerator, etc. is released from the upper end 22 of the nipple or from the right-angled bend end 30 of the elbow where it is connected. The components of the kit are then set up for assembly, one of the hose couplers is secured within the matching threads with the cap or plug then clamped into securement. The shaft is then force-fit through the orifice 50 or the orifice 27, and then grasped, pushed and rotated in a circular plane through the cap 42 or the plug 25, the coupler 32 and the valve 18 to clear whatever clogging is present. As will be appreciated by those skilled in the art, however, before disconnecting the pump hose from the nipple or elbow, and connecting the assembled components of the invention, the handle 20 of the thruhole fitting valve 18 is first rotated to the horizontal position to close the valve—and once everything is in place for the shaft to be inserted, the handle is rotated to the vertical positioning for opening the valve 18 so the shaft can be pushed through the valve 18 to clear the blockage. Once it is determined that the clogging has been cleared, the shaft can be withdrawn, the valve 18 closed by rotating the handle 20 back to its horizontal position, the coupler 32 and the cap or plug removed from the nipple or elbow, and the hose from the pump then reconnected. The component parts of the kit are then broken down for placement back into the compartment 80 for use at a later time when needed again.

While there has been described what is considered to be a preferred embodiment of the present invention, it will be readily appreciated by those skilled in the art that modifications can be made without departing from the scope of the teachings herein. Thus, while a preferred embodiment may employ a kit of only one coupler, one cap or plug and one shaft, other kits of different variations and number may be employed as well—for example, a kit may be provided which includes four differently diameter cylindrical couplers 32 and four correspondingly sized sealing caps 42 or plugs 25, along with an appropriate number of securing hose clamps 44, and either one or both of the shafts 54 and 66. For at least such reason, therefore, resort should be had to the claims appended hereto for a true understanding of the scope of the invention.

I claim:

1. A kit for clearing the water intake systems of pleasure boats, fishing boats and yacht marine craft employing a nipple or elbow connection to the internal threads of a thruhole fitting valve in a water conduit leading from a source of marine water via a hose to a pump aboard the boat or craft comprising:

a hollow substantially cylindrical male hose coupler having external threads at a first end to connect with the internal threads of the thruhole fitting valve and having an outwardly extending flange at an opposite second end;

an open-end cap to receive said second end of said coupler, and having a substantially central orifice of given diameter;

a clamp to secure said cap about said extending flange; and a shaft of diameter greater than that of said orifice but able to fit therethrough, said shaft being of a length to extend through said open-end cap, said hose coupler and through said nipple or elbow beyond said thruhole fitting valve when opened; and with said shaft being of a strength sufficient to force-free any intake conduit hose connected to said valve of clogging material therein.

2. The kit of claim 1 wherein said open-end cap is of a resilience to accept manual rotation of said shaft in and about said orifice in force-freeing of said valve in any intake conduit hose in substantially a 360° plane of rotation.

3. The kit of claim 2 wherein said shaft includes a slanted groove cut-out at a lower end and a handle at an upper end.

4. The kit of claim 2 wherein said shaft includes a slanted groove cut-out at a lower end and a substantially circular knob handle at an upper end having a flat portion in alignment with the groove cut-out at said lower end.

5. The kit of claim 2, also including a storage package for said hose coupler, said clamp, said open-end cap and said shaft.

6. A kit for clearing the water intake systems of pleasure boats, fishing boats and yacht marine craft employing a nipple or elbow connection to the internal threads of a thruhole fitting valve in a water conduit leading from a source of marine water via a hose to a pump aboard the boat or craft comprising:

a plurality of increasingly-sized hollow, substantially cylindrical male hose couplers having external threads at a first end and an outwardly extending flange at an opposite second end;

a plurality of open-end caps to individually receive said second end of one of said increasingly sized hose couplers and having a substantially central orifice of given diameter;

a clamp to secure a selected one of said one-end caps about the outwardly extending flange of a selected one of said hose couplers and having a substantially central orifice of given diameter;

a shaft of diameter greater than that of said orifice but able to force-fit therethrough, said shaft being of a length to extend through each of said open-end caps, each of said hose couplers and through a selected one of said nipple or elbow beyond its associated thruhole fitting valve when opened;

and with said shaft being of a strength sufficient to force free any intake conduit hose connected to said selected intake valve of clogging material therein.

7. The kit of claim 6 wherein each of said open-end caps is of resilience to accept manual rotation of said shaft in and about its respective orifice in force-freeing of its selected intake conduit hose and valve in substantially a 360° plane of rotation.

8. The kit of claim 7 wherein said shaft includes a slanted groove cut-out at a lower end and a handle at an upper end.

9. The kit of claim 8 wherein said shaft includes a slanted groove cut-out at a lower end and a substantially circular knob handle at an upper end having a flat portion in alignment with the groove cut-out at said lower end.

10. The kit of claim 9, also including a storage package for each of said hose couplers, each of said open-end caps, said clamp and said shaft.

11. A kit for clearing the water intake systems of pleasure boats, fishing boats and yacht marine craft employing a nipple or elbow connection to the internal threads of a thruhole fitting valve in a water conduit leading from a source of marine water via a hose to a pump aboard the boat or craft comprising:

a plurality of increasingly-sized hollow, substantially cylindrical male hose couplers having external threads at a first end and an outwardly extending flange at an opposite second end;

an open-end cap having a substantially central orifice of given diameter;

a plurality of decreasingly sized rings for insertion into said cap to individually receive said second end of one of said increasingly sized hose couplers; and a shaft of diameter greater than that of said orifice but able to force-fit therethrough, said shaft being of a length to extend through said open-end cap, individual ones of said plurality of hose couplers and through said nipple or elbow beyond said thruhole fitting valve when opened; and with said shaft being of a strength sufficient to force-free any intake conduit hose connected to its associated valve of clogging material therein.

12. The kit of claim 11 wherein said open-end cap is of a resilience to accept manual rotation of said shaft in and about said orifice in force-freeing of said valve in substantially a 360° plane of rotation.

13. The kit of claim 12 wherein said shaft includes a slanted groove cut-out at a lower end and a handle at an upper end.

14. The kit of claim 13 wherein said shaft includes a slanted groove cut-out at a lower end and a substantially circular knob handle at an upper end having a flat portion in alignment with the groove cut-out at said lower end.

15. The kit of claim 12, also including a storage package for each of said hose couplers, said clamp, said open-end cap, said rings, and said shaft.

* * * * *